US006860793B2

(12) United States Patent
Budinger et al.

(10) Patent No.: US 6,860,793 B2
(45) Date of Patent: Mar. 1, 2005

(54) WINDOW PORTION WITH AN ADJUSTED RATE OF WEAR

(75) Inventors: William D. Budinger, Key West, FL (US); Naoto Kubo, Nara Pref (JP)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 0 days.

(21) Appl. No.: 09/805,328

(22) Filed: Mar. 13, 2001

(65) Prior Publication Data

US 2001/0053658 A1 Dec. 20, 2001

Related U.S. Application Data

(60) Provisional application No. 60/189,386, filed on Mar. 15, 2000.

(51) Int. Cl.[7] ..... B24B 1/00
(52) U.S. Cl. ..... 451/41
(58) Field of Search ..... 451/41, 28, 527, 451/526, 528, 533, 285–288; 438/7–8, 692

(56) References Cited

U.S. PATENT DOCUMENTS

| | | | | |
|---|---|---|---|---|
| 5,413,941 | A | 5/1995 | Koos et al. | |
| 5,605,760 | A | 2/1997 | Roberts | |
| 5,893,796 | A | 4/1999 | Birang et al. | |
| 5,985,679 | A * | 11/1999 | Berman | 438/7 |
| 6,171,181 | B1 * | 1/2001 | Roberts et al. | 451/527 |
| 6,280,290 | B1 * | 8/2001 | Birang et al. | 451/6 |
| 6,354,929 | B1 * | 3/2002 | Adefris et al. | 451/527 |
| 6,428,386 | B1 * | 8/2002 | Bartlett | 451/6 |
| 6,454,630 | B1 * | 9/2002 | Tolles | 451/6 |
| 6,537,133 | B1 * | 3/2003 | Birang et al. | 451/6 |
| 2003/0171081 | A1 | 9/2003 | Komukai et al. | |

FOREIGN PATENT DOCUMENTS

EP 0 829 328 A2 3/1998

* cited by examiner

*Primary Examiner*—Lee D. Wilson
(74) *Attorney, Agent, or Firm*—Gerald K. Kita; Edwin Oh

(57) ABSTRACT

A polishing pad includes a polishing layer, and the transparent window portion of the polishing layer having dispersed particles to increase the rate at which the window portion wears away during a polishing operation, and to avoid forming a lump in the polishing layer.

13 Claims, No Drawings

WINDOW PORTION WITH AN ADJUSTED RATE OF WEAR

CROSS REFERENCE TO RELATED APPLICATION

This application claims the benefit of provisional application Ser. No. 60/189,386, filed Mar. 15, 2000.

FIELD OF THE INVENTION

The invention relates to a polishing pad having a transparent window portion in a polishing layer.

DISCUSSION OF RELATED ART

A polishing operation is performed on a semiconductor wafer to remove excess material, and to provide the wafer with a smooth, planar polished surface. To attain the smooth, planar polished surface, the polishing layer of the polishing pad provides a uniform polishing action. During the polishing operation, polishing pressure is exerted on the window portion and on the remainder of the polishing layer.

U.S. Pat. No. 5,893,796 discloses a known polishing pad having a transparent window portion installed in a polishing layer of the polishing pad. It has been found that the window portion was fabricated with materials that have an inherent resistance to wear. Other materials in a remainder of the polishing layer have a lower resistance to wear. Thus, as a polishing layer slowly wears away as it is being used to polish a semiconductor wafer, the transparent window portion wears away more slowly, at a lower rate of wear. As a result, the transparent window portion becomes a lump on the polishing layer, the lump having a height greater than the height of the remainder of the polishing layer.

The window portion, being a lump on the polishing layer, is pressed inward by the polishing pressure to become flush with the polishing surface. However, the inwardly pressed window portion polishes with a different polishing action than that of the remainder of the polishing layer. For example, the window portion, as a lump, concentrates polishing force against the semiconductor wafer, which produces a nonuniform polishing action. Consequently, the nonuniform polishing action produces defects in the smooth, planar polished surface on the semiconductor wafer.

A need exists for a polishing pad having a polishing layer with a transparent window portion, which provides a uniform polishing action as the polishing layer undergoes wear during a polishing operation.

Further a need exists for a transparent window portion that avoids becoming a lump on a worn polishing layer of a polishing pad.

SUMMARY OF THE INVENTION

According to the invention, a transparent window portion of a polishing layer is provided with dispersed particles of at least one, or more than one, substance dispersed throughout the window portion to increase the rate at which the window portion wears away during a polishing operation and to avoid forming a lump in the polishing layer.

Embodiments of the invention will now be described by way of example with reference to the following detailed description.

DETAILED DESCRIPTION

Embodiments of the invention will now be described by way of example with reference to the following detailed description.

A semiconductor wafer having integrated circuits fabricated thereon must be polished to provide a very smooth and flat wafer surface which in some cases may vary from a given plane by as little as a fraction of a micron. Such polishing is usually accomplished in a chemical-mechanical polishing (CMP) operation that utilizes a chemically active slurry that is buffed against the wafer surface by a polishing pad. Methods have been developed for determining when the wafer has been polished to a desired endpoint. According to U.S. Pat. No. 5,413,941, one such method includes light generated by a laser to measure a wafer dimension.

According to a known polishing pad, the surface of the transparent window portion is flush with the polishing surface of the polishing pad. The window portion and the polishing surface are in contact with the workpiece, i.e. semiconductor wafer, being polished.

When the window portion has a wear rate that is lower (i.e., it wears slower) than that of the polishing surface surrounding it, the polishing layer wears away at a rate that is faster than the rate at which the window portion wears away. The height of the window portion becomes greater than the height of the polishing layer. The performance of the polishing pad is jeopardized.

A polishing operation is performed on a semiconductor wafer to remove excess material, and to provide the wafer with a smooth, planar polished surface. To attain the smooth, planar polished surface, the polishing layer of the polishing pad provides a uniform polishing action. During the polishing operation, polishing pressure is exerted on the window portion and on the remainder of the polishing layer. The window portion, being a lump on the polishing layer, is pressed inward by the polishing pressure to become flush with the polishing surface. However, the inwardly pressed window portion polishes with a different polishing action than that of the remainder of the polishing layer. For example, the window portion, as a lump, concentrates polishing force against the semiconductor wafer, which produces a non-uniform polishing action.

Examples of such pads include urethane impregnated polyester felts, microporous urethane pads of the type sold as Politex® by Rodel, Inc. of Newark, Del., and filled and/or blown composite urethanes such as IC-series and MH-series polishing pads also manufactured by Rodel, Inc. of Newark, Del. Window portions used in these types of urethane pads typically comprise urethane with the standard additives in the Politex® and IC- and MH-series.

A known polymeric pad has a matrix that comprises materials selected from polyurethanes, acrylics, polycarbonates, nylons, polyesters, polyvinyl chlorides, polyvinylidene fluorides, polyether sulfones, polystyrenes, and polyethylenes, polyurethanes, acrylics, polycarbonates, nylons, and polyesters with higher wear rates than the currently used polyurethanes.

A known polymeric matrix that can be used according to the invention comprises materials selected from polyurethanes, acrylics, polycarbonates, nylons, polyesters, polyvinyl chlorides, polyvinylidene fluorides, polyether sulfones, polystyrenes, polyethylenes, FEP, Teflon AF®, and the like. Other materials are polyurethanes, acrylics, polycarbonates, nylons, polyesters and polyurethanes. Further examples include polymethylmethacrylate sheets (e.g., Plexiglas® sold by Rohm and Haas, Philadelphia, Pa.) and polycarbonate plastic sheets (e.g., Lexan® sold by General Electric). Casting or extruding the polymer and then curing the polymer to the desired size and thickness can make the window portions.

The polishing pad comprises a polymeric matrix formed from urethanes, melamines, polyesters, polysulfones, polyvinyl acetates, fluorinated hydrocarbons, and the like, and mixtures, copolymers and grafts thereof. The polymeric matrix comprises a urethane polymer. The urethane polymer is advantageously formed from a polyether-based liquid urethane, such as the Adiprene™ line of products that are commercially available from Uniroyal Chemical Co., Inc. of Middlebury, Conn. For example, a liquid urethane contains about 9 to about 9.3% by weight free isocyanate. Other isocyanate bearing products and prepolymers may also be used. The liquid urethane is advantageously one which reacts with a polyfunctional amine, diamine, triamine or polyfunctional hydroxyl compound or mixed functionality compounds such as hydroxyl/amines dwelling in urethane/urea crosslinked networks to permit the formation of urea links and a cured/crosslinked polymer network. The liquid urethane is reacted with 4,4'-methylene-bis(2-chloroaniline) ("MOCA"), which is commercially available as the product CURENE® 442, from Anderson Development Co. of Adrian, Mich.

Forming a window portion comprising a phase separated or biphasic system is accomplished by blending two immiscible polymers until their domain size will not scatter light and then polymerizing them in the shape of a window portion. The immiscible polymer is expected to provide a window portion with particulates of immiscible polymer providing an increased WR. Pairs of immiscible polymers can include, but are not limited to, polyurea/polyurethane, nitrocellulose/acrylic and the like.

If the wear rate (WR) of the transparent window portion is equal to or greater than the WR of the polishing surface, then the window portion will be expected to remain flush with the polishing surface during a polishing operation. Wear rate is a measure of how quickly the surface of the window portion surface or polishing surface is removed, or worn away, during chemical-mechanical polishing. Abrasion resistance, or resistance to abrasion, is a measure of how the surface of the window portion or of the polishing surface avoids being removed or worn away by abrasion during chemical-mechanical polishing. The invention provides a transparent window portion that has a higher wear rate and lower abrasion resistance than window portions fabricated with materials having inherently high resistance to wear, as in previous polishing pads. Advantageously, the $WR_{window\ portion}$ is equal to or at least 5, 10, 15, 20, 25, 50, 100, or 200% greater than $WR_{pol\ surface}$. More advantageously, the $WR_{window\ portion}$ is 5, 10, 15, 20, to 25% greater than $WR_{pol\ surface}$.

The invention provides a transparent window portion comprised of a polymeric matrix further comprising a discontinuity that increases the wear rate (or decreases the abrasion resistance) of the window portion compared with the polymeric matrix without the discontinuity.

Discontinuity, as used herein, is intended to mean that the polymeric matrix has been disrupted by the presence of a foreign material. A desired discontinuity is one that increases the WR of the polymeric matrix. The amount of the disruption or discontinuity depends on the desired WR of the polymeric matrix. Discontinuities can be obtained by the forming the polymeric matrix in the presence of solid particles, fluids, gases, or an immiscible polymer system. The polymeric matrixes are prepared so that the discontinuities do not mechanically reinforce the matrix or are so large as to cause scattering of an incident optical beam that prohibits optical end-point detection. Additives can include solid particles (e.g., silica, titania, alumina, ceria, or plastic particles). Advantageously the additives are plastic particles. Nanometer sized particles, are particles of one nanometer and less in size, that are of sufficiently low surface area to avoid scattering of incident light. Dispersal of the particles in the window portion, rather than agglomeration of the particles, further avoids scattering of incident light.

The particles (e.g., plastic particles) can range in diameter from 1 nm to 200 $\mu$m, advantageously from 1 to 50 $\mu$m, more advantageously from 10–20 $\mu$m. The actual shape of the plastic particles is not limited. It can include chips, squares, discs, pucks, donuts, spheres, cubes, irregular shapes, etc. Advantageously, from 1, 2, 3, 4, 5, 6, 7, 8, 9 to 10% of the weight of the window portion is from the solid particles.

The plastic comprising the particles is chosen depending on the polymeric matrix of the window portion. The plastic is chosen such that its presence has little or no effect on the index of refraction of the window portion. Advantageously the plastic has about the same index of refraction as the polymeric matrix of the window portion. Advantageously the plastic is the same as the polymeric matrix of the window portion. Thus, the plastic can be selected from polyurethanes, acrylics, polycarbonates, nylons, polyesters, polyvinyl chlorides, polyvinylidene fluorides, polyether sulfones, polystyrenes, and polyethylenes. Advantageously, the plastic is selected from polyurethanes, acrylics, polycarbonates, nylons, and polyesters. More advantageously, the plastic is polyurethane.

Fluids in the form of a polymeric emulsion are expected to create a discontinuity. By forming the window portion in the presence of a fluid, a polymeric matrix can be obtained that encapsulates the fluid in individual, spaced cells, including bubbles. This is expected to increase the WR of the window portion. Advantageously, from 1, 2, 3, 4, 5, 6, 7, 8, 9 to 10% of the weight of the window portion is from the fluid. For example, such fluids or liquids include hydrocarbon oils such as mineral oil.

Another discontinuity can be the presence of a gas in the polymeric matrix. By forming the window portion in the presence of a gas type fluid, a polymeric matrix can be obtained that encapsulates the fluid in individual, spaced cells, including bubbles. Advantageously, from 85, 86, 87, 88, 89, 90, 91, 92, 93, 94, 95, 96, 97, 98 to 99% of the volume of the window portion is a gas (e.g., air, carbon dioxide, or nitrogen). For example, an aerogel is a silica aerogel. The silica aerogels are prepared from silicon alkoxides, advantageously tetramethyl orthosilicate or tetraethyl orthosilicate.

The transparent window portion of the present invention should be transparent to light having a wavelength within the range of 190 to 3500 nanometers, depending on the application and optical device being used to monitor the polishing process. The transparent window portion should also be transparent to allow for optical end-point detection of the device being polished.

Embodiments of the invention having been disclosed, other embodiments and modifications of the invention are intended to be covered by the spirit and scope of the appended claims.

What is claimed is:

1. A polishing pad for chemical mechanical polishing a semiconductor wafer comprising:

a polishing surface having a first wear rate during polishing;

a window portion formed in the polishing pad and having a window surface formed flush with the polishing surface; and wherein the window surface has a second wear rate during polishing greater than the first wear rate.

2. The polishing pad of claim 1, wherein the second wear rate is 5% to 25% greater than the first wear rate.

3. The polishing pad of claim 1, wherein the window portion includes a polymerized blend of two immiscible polymers.

4. The polishing pad of claim 1, wherein the window portion includes at least one of polymethylmethacrylate and polycarbonate.

5. The polishing pad of claim 1, wherein the window portion includes a polymer matrix having discontinuities formed therein that act to increase the wear rate of the polymer matrix without significantly contributing to light scattering.

6. The polishing pad of claim 5, wherein the discontinuities include at least one selected from the group of discontinuities comprising: solid particles, fluids, gases and immiscible polymers.

7. The polishing pad of claim 5, wherein the discontinuities include solid matter having a lower resistance to wear than the polymer matrix.

8. The polishing pad of claim 7, wherein the solid matter includes at least one type of solid particles selected from the group of particles comprising: silica, titania, alumina, ceria, and plastic.

9. An apparatus for polishing a wafer comprising:

a polishing pad having a surface and a first wear rate during polishing;

a window portion formed in the polishing pad and having a surface formed flush with the polishing pad surface;

wherein the window portion has a second wear rate during polishing equal to or greater than the first wear rate so that the window surface remains flush with the polishing pad surface during polishing; and wherein the second wear rate is 5% to 25% greater than the first wear rate.

10. An apparatus for polishing a wafer comprising:

a polishing pad having a surface and a first wear rate during polishing;

a window portion formed in the polishing pad and having a surface formed flush with the polishing pad surface;

wherein the window portion has a second wear rate during polishing equal to or greater than the first wear rate so that the window surface remains flush with the polishing pad surface during polishing; and wherein the window portion includes a polymer matrix having discontinuities formed therein that act to increase the wear rate of the polymer matrix without significantly contributing to light scattering.

11. The apparatus of claim 10, wherein the discontinuities include at least one selected from the group of discontinuities comprising: solid particles, fluids, gases and immiscible polymers.

12. The apparatus of claim 11, wherein the discontinuities include solid matter having a lower resistance to wear than the polymer matrix.

13. The apparatus of claim 12, wherein the solid matter includes at least one type of solid particles selected from the group of particles comprising: silica, titania, alumina, ceria, and plastic.

* * * * *